US005485774A

United States Patent [19]

Osborne

[11] Patent Number: 5,485,774

[45] Date of Patent: Jan. 23, 1996

[54] TEXTILE BRAIDS FOR CABLES, FLEXIBLE TUBES AND THE LIKE

[75] Inventor: Robert Osborne, Brockville, Canada

[73] Assignee: Phillips Cables Limited, Ontario, Canada

[21] Appl. No.: 247,260

[22] Filed: May 23, 1994

[30] Foreign Application Priority Data

Jul. 31, 1993 [GB] United Kingdom ..... 9315910

[51] Int. Cl.[6] ..... D04C 1/00

[52] U.S. Cl. ..... 87/6; 87/9

[58] Field of Search ..... 87/6, 7, 8, 9, 13, 87/33, 44

[56] References Cited

U.S. PATENT DOCUMENTS

| | | | |
|---|---|---|---|
| 182,945 | 10/1876 | Moll | 87/7 |
| 559,080 | 4/1896 | Hughes | 87/7 X |
| 1,076,759 | 10/1913 | Gore | 87/7 |
| 1,439,323 | 12/1922 | Petersen | 87/7 X |
| 1,465,554 | 8/1923 | Klein | 87/9 X |
| 1,814,223 | 7/1931 | Murphy | 87/9 |
| 2,238,644 | 4/1941 | Hodges | 87/44 |
| 3,390,602 | 7/1968 | Ohno | 87/7 |
| 3,892,161 | 7/1975 | Sokol | 87/44 X |
| 4,567,917 | 2/1986 | Millard | 87/9 X |

FOREIGN PATENT DOCUMENTS

| | | | |
|---|---|---|---|
| 389162 | 9/1908 | France | 87/8 |
| 1298368 | 6/1962 | France | 87/8 |
| 19160 | of 1905 | United Kingdom | 87/8 |

*Primary Examiner*—Joseph J. Hail, III
*Attorney, Agent, or Firm*—Oliff & Berridge

[57] ABSTRACT

In an electric cable or other elongate body, a tubular textile braid comprises two sets of yarns each made up of a plurality of synthetic monofilaments, the yarns of the two sets extending in opposite directions around the axis of the braid corresponding to upper and lower yarns in the braiding machine differing in twist to an extent such that the more twisted yarns have their tensile strength increased by at least 10% but do not have their cover in the braid decreased by more then 25%, both by comparison with an otherwise identical yarn having the same twist of those of the ess twisted set. Preferably the twist in the upper yarns is zero. The invention allows higher production speed and reduced down-time without significant loss of cover, because the small extra twist in the lower yarns gives them better abrasion resistance to withstand passage through their greater exposure in the braiding machine.

8 Claims, 3 Drawing Sheets

TEXTILE BRAIDS FOR CABLES, FLEXIBLE TUBES AND THE LIKE

BACKGROUND OF THE INVENTION

1. Field of the Invention

This invention relates to tubular textile braids forming parts of electric cables or other elongate bodies (such as optical cables and flexible pipes). It is more specifically concerned with braids formed from yarns comprising many monofilaments of synthetic textile material. p 2. Description of the Related Art Such braids are used to achieve pressure-withstand characteristics and/or for aesthetic reasons, and in either case it is desirable to achieve as nearly as possible 100% coverage of textile material over the underlying core. This is in conflict with the practical requirements for adequate tensile strength and abrasion resistance, which would otherwise suggest the use of twisted yarns, and in many cases yarns with practically no twist have been used. Such yarns are susceptible to fraying and breakage in the braiding machine, and this susceptibility not only limits the running speed of the machine but also gives rise to frequent interruptions and consequent down-time.

In a braiding machine, yarns are divided into two groups, usually referred to as "upper" and "lower" on the assumption that the axis of the machine is vertical; yarns of the lower group have to be moved around a sinuous path in order to cross over and under those of the upper group to weave the required braid pattern, and this inevitably exposes them to greater abrasion than those of the upper group; we have now recognized that this difference creates an opportunity to increase braiding speed and/or reduce down-time without unacceptably reducing yarn coverage.

SUMMARY OF THE INVENTION

In accordance with one aspect of the invention, a tubular textile braid comprises two sets of yarns each made up of a plurality of synthetic monofilaments, the yarns of the two sets extending in opposite directions around the axis of the braid (and so corresponding to upper and lower yarns in the braiding machine) differing in twist to an extent such that the more twisted yarns have their tensile strength increased by at least 10% but do not have their cover in the braid decreased by more then 25% (both by comparison with an otherwise identical yarn having the same twist as those of the less twisted set).

Preferably the twist in the yarns of one set (corresponding to the upper set) is substantially zero.

The degree of twist that is appropriate will of course vary with the size and other characteristics of the yarn. For smooth multi-monofilament polyamide yarns of the sizes commonly used in braiding cables, we estimate that two twists per meter will give a slight improvement but prefer to apply at least three twists per meter and more especially about four twists per meter. At the other extreme, we prefer not to apply more than six twists per meter to this kind of yarn, as at that level increased twist tends to reduce bulk and coverage unacceptably.

The invention includes a process for making the braid defined in which the bobbins of a braiding machine are loaded with different yarns, the bobbins of the lower set being loaded with yarns having a higher degree of twist from those loaded in the bobbins of the upper set, shown in FIG. 3, to an extent such that the more twisted yarns have their tensile strength increased by at least 10% but do not have their cover in the braid decreased by more then 25% (both by comparison with an otherwise identical yarn having the same twist as those of the less twisted set).

In addition to differing in twist, the yarns may differ in other characteristics; in particular, the yarns of higher twist may also have a higher tex value (linear density) to compensate in whole or in part the reduction in coverage due to the level of twist.

BRIEF DESCRIPTION OF THE DRAWINGS

The invention will be further described, by way of example, with reference to the accompanying drawings in which.

DESCRIPTION OF THE PREFERRED EMBODIMENTS

Figure 1:
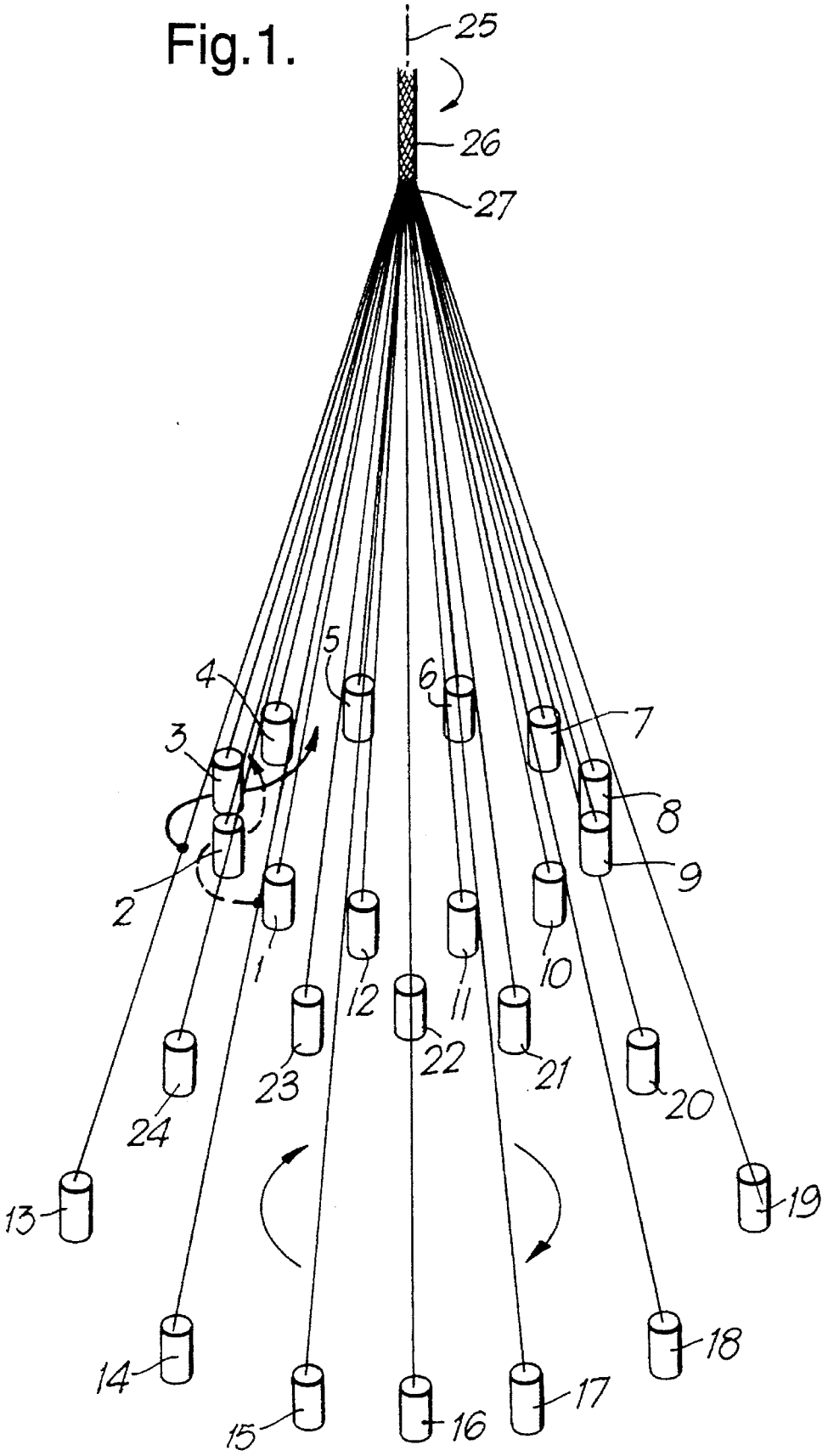
FIG. 1 is a schematic sketch of a braiding machine that relates to this invention.
Figure 3A:
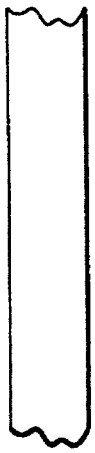
FIGS. 3A and 3V are sketches of untwisted or low twist years that are used in the top set of bobbins of the braiding machine of FIG. 1.
Figure 3B:
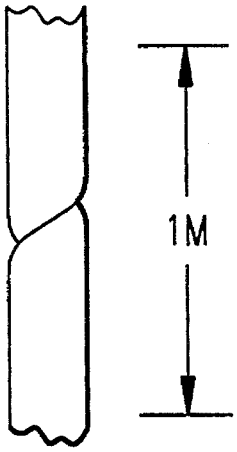
Figure 4A:
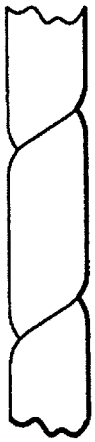
FIGS. 4A and 4B are sketches of higher twist yarns that are used in the bottom set of bobbins of the braiding machine of FIG. 1.
Figure 4B:
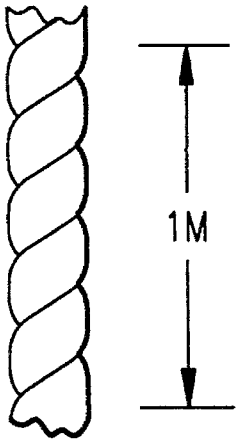

For clarity of illustration, the braiding machine of FIG. 1 is sketched as if the upper set of bobbins 1,2,3 . . . 12 were stationary while the lower set of bobbins 13,14,15, . . . 24 rotate in a clockwise direction as seen from above around a vertical central axis 25. This is a practicable possibility, provided the product 26 is taken up by a reel or the like that rotates about the axis 25 at half the speed of the lower-set bobbins; the usual arrangement, however, is for the take-up to be stationary with respect to this rotation axis and for the two sets of bobbins to rotate at the same angular speed in opposite directions: the relative motions are the same. Superimposed on the motions so far described are movements necessary to produce interweaving of the yarns as they pass from the reels 1–24 to the braiding point 27. Mechanisms for doing this are well known and form no part of this invention, so they will not be described in any detail here. It is sufficient to understand that either by radial reciprocating movement of one or both sets of bobbins or of guides engaging the yarns from the lower set of bobbins as they pass from those bobbins to the braiding point, each yarn coming from a bobbin of the lower set (see FIG. 4) is caused to pass radially inside some of the yarns coming from bobbins of the upper set (see FIG. 3), and radially outside the others. While more complex patterns can be used, the simplest and commonest is one in which each lower-set yarn passes alternately under and over upperset yarns, sometimes called a 1-over-1-under-1 braid; thus, as illustrated, the yarn coming from lower-set bobbin 13 is deflected radially outwards to pass outside the yarn cooling from upper-set bobbin 3 (and in turn outside those from the other odd-numbered upper-set bobbins 5–11, 1) and then radially inwardly to pass inside the yarn coming from upper-set bobbin 4 (and in turn inside those from the other even-numbered upper-set bobbins 6–12, 2); the yarns from other odd-numbered lower-set bobbins 15–23 follow the same path in their turns, while those from the even-numbered lower-set bobbins 14–24 pass inside those from the odd-numbered upper-set bobbins and outside the even-numbered ones.

Example 1

Figure 2:
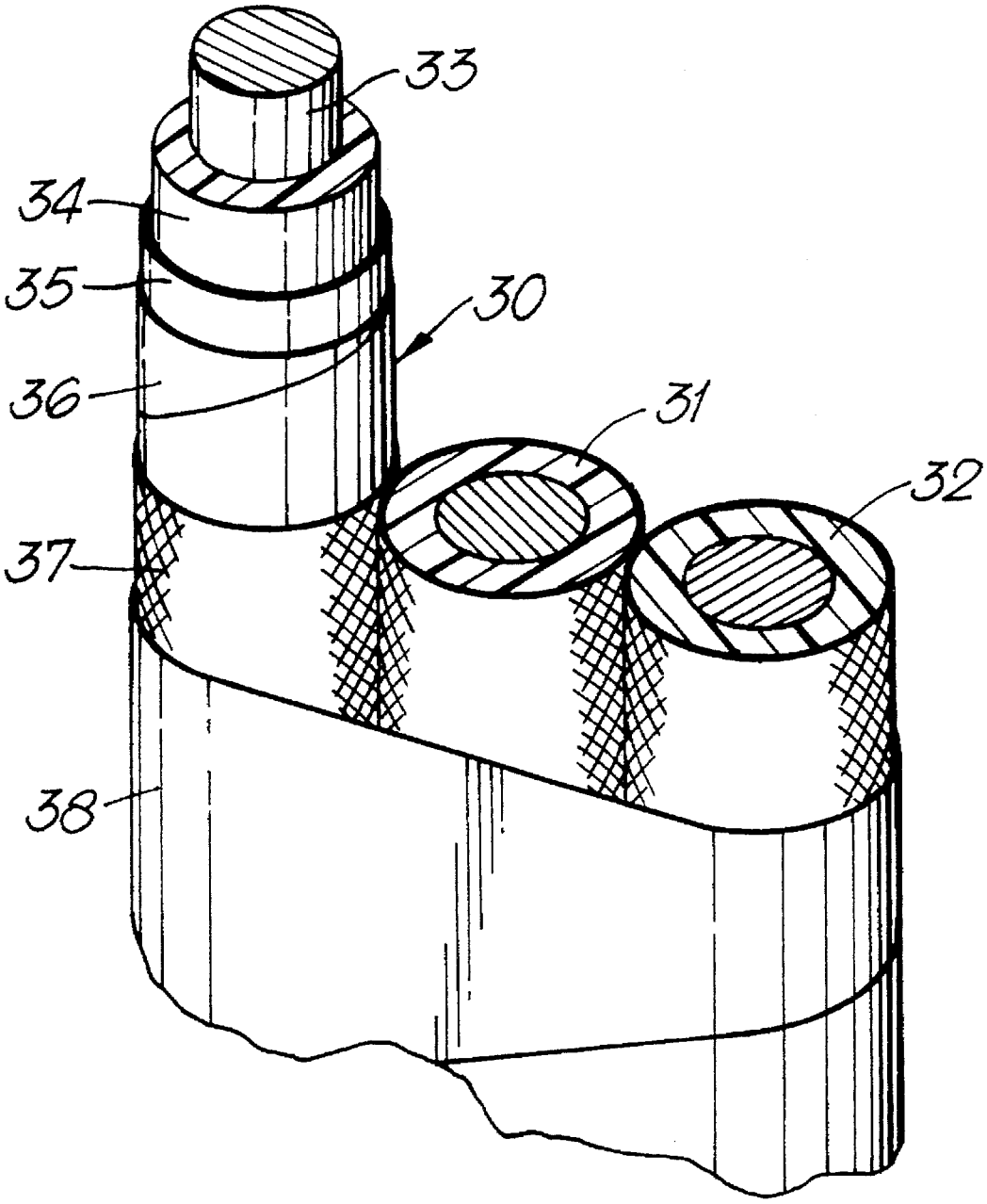
FIG. 2 is a conventional cutaway diagram of one form of cable in accordance with the invention.

The flat downwell pump cable shown in FIG. 2 comprises three cores 30–32 each comprising a solid 21mm$^2$ (#4AWG) tinned copper conductor 33 with 2.3mm radial thickness of insulation 34 formed of an insulation grade of polypropylene, a jacket 35 of 1.3mm radial thickness of a conventional nitrile rubber composition over which is applied an oil-resistant polyvinyl fluoride tape 36, 38mm wide by 0.05mm thick, helically lapped with 25% overlap. Over this tape is applied a polyamide braid 37 formed, using a Wardwellian braiding machine set up with the usual 12 carriers in each of the upper and lower sets. All 24 bobbins are loaded with polyamide yarns each of 188tex and each comprising about 280 monofilaments. The yarns loaded in the bobbins 1–12 of the upper set are "flat" and untwisted; in accordance with the invention, those loaded in the bobbins 13–24 of the lower set have a twist of about 1 turn per 250mm, which increases their tensile strength by about 25%. The braid structure is a basic 1-over-1-under-1 as described above , and despite the presence of twist in some of the yarns the coverage is nearly 100% and the depressurisation performance fully meets requirements.

The braiding machine operated at a line speed of 4.4 metres per minute with a downtime of about 15%, compared with about 50% when operating conventionally with similar but all untwisted yarns on all the bobbins. Alternatively we predict that the line speed could have been increased to about 5.3 meters per minute leaving the downtime unaltered.

To complete the cable, the cores 30–32 are laid parallel and armoured with 13 by 0.5mm galvanised steel strip 38 applied with 50% overlap (about 140 turns per metre).

Example 2

A core for a 3-core cable for supply of power to a downwell pump in the oil industry has a 35mm$^2$ (#2AWG) sealed stranded soft-annealed copper conductor insulated with 1.9mm nominal radial thickness of a conventional cable-making ethylene-propylene-diene terpolymer rubber composition over which is applied an oil-resistant polyvinyl fluoride tape and a polyamide braid exactly like those used in Example 1.

To complete this cable (which is otherwise entirely conventional) the braid was laquered with a commercially available saturant and three such cores laid up around a textile-cored central soft rubber filler 2.7mm in diameter, sheathed with 1.5mm nominal radial thickness of a conventional ethylene-propylenediene terpolymer rubber sheathing compound, shaped to form external longitudinal ribs, and armoured with interlocked steel tapes (12.5 mm wide by 0.64mm thick).

Example 3

Another flat pump cable has three cores each comprising a 16mm$^2$ plain annealed copper conductor with 1.9 mm radial thickness of an insulation grade of ethylene-propylene-diene terpolymer rubber (EPDM) and 1.3mm radial thickness of a jacketing grade of EPDM. Tape, braiding, make-up and armouring are substantially the same as in Example 1.

Example 4

Another design of downwell pump cable comprises three cores each comprising a 21mm$^2$ plain copper conductor insulated with 1.9mm radial thickness of an insulating grade of EPDM and jacketed with 1.0mm nominal radial thickness of a cable-sheathing lead alloy. The jacket is lightly smeared with a hydrocarbon lubricant (sold under the trademark Sunvis 931). Braiding immediately follows (without taping) and is exactly as in the preceding Examples except that one of the top carriers is loaded with a 176-tex semiconducting black flat polyamide yarn. Make-up and armouring are substantially the same as in Examples 1 and 3.

I claim:

1. A tubular textile braid comprising first and second sets of yarns each yarn made up of a plurality of synthetic monofilaments, the yarns of said first set all extending in one direction around the axis of the braid and the yarns of said second set in the opposite direction, all the yarns of said first set having equal twists and all the yarns of said second set having equal twists but the yarns of said first and second set differing in twist to an extent such that the yarns of said second set have their tensile strength increased by at least 10% but do not have their cover in the braid decreased by more than 25%, both by comparison with an otherwise identical yarn having the same twist as that of said first set.

2. A braid in accordance with claim 1 in which said twist in the yarns of said first set is zero.

3. A braid in accordance with claim 1 in which the yarns of said second set have a higher tex value than the yarns of said first set to compensate at least in part for the reduction in coverage due to said twist.

4. An electric cable comprising at least one insulated electric conductor and an enclosing textile braid, said braid comprising first and second sets of yarns each yarn made up of a plurality of synthetic monofilaments, the yarns of said first set all extending in one direction around the axis of the braid and the yarns of said second set in the opposite direction, all the yarns of said first set having equal twists and all the yarns of said second set having equal twists but the yarns of said first and second set differing in twist to an extent such that the yarns of said second set have their tensile strength increased by at least 10% but do not have their cover in the braid decreased by more than 25%, both by comparison with an otherwise identical yarn having the same twist as that of said first set.

5. A cable in accordance with claim 4 in which said braid is formed of smooth multi-monofilament polyamide yarns and in which the twist in the yarns of said first set is substantially zero and the twist in the yarns of said second set is in the range 2–6 twists per meter.

6. A cable in accordance with claim 4 in which said braid is formed of smooth multi-monofilament polyamide yarns and in which the twist in the yarns of said first set is substantially zero and the twist in the yarns of said second set is in the range 3–6 twists per meter.

7. A cable in accordance with claim 4 in which said braid is formed of smooth multi-monofilament polyamide yarns and in which the twist in the yarns of said first set is substantially zero and the twist in the yarns of said second set is about 4 twists per meter.

8. A process for making a tubular textile braid comprising:

providing a braiding machine having upper and lower bobbin sets, means for rotating said upper and lower bobbin sets in opposite directions, and means for assembling and braiding yarns from bobbins in said sets as they rotate;

loading the bobbins of said upper set with first synthetic monofilament yarns having the same twist;

loading the bobbins of said lower set with second synthetic monofilament yarns having a greater twist than said first synthetic monofilament yarns to an extent such that said second synthetic monofilament yarns have their tensile strength increased by at least 10% but do not have their cover in the braid decreased by more than 25%, both by comparison with an otherwise identical yarn having the same twist as the said first synthetic monofilament yarns;

and causing said braiding machine to operate.

* * * * *